United States Patent [19]

Kronich

[11] Patent Number: 4,928,651

[45] Date of Patent: May 29, 1990

[54] INTEGRAL ENGINE BLOCK AIR COOLED ENGINE OIL COOLER

[75] Inventor: Peter G. Kronich, Sheboygan, Wis.

[73] Assignee: Tecumseh Products Company, Tecumseh, Mich.

[21] Appl. No.: 371,455

[22] Filed: Jun. 26, 1989

[51] Int. Cl.[5] ..... F01M 1/00

[52] U.S. Cl. ..... 123/196 AB; 123/41.56; 123/41.57; 123/196 W; 184/104.2; 184/6.5

[58] Field of Search ..... 123/196 AB, 41.56, 41.57, 123/196 W; 104/104.2, 6.5

[56] References Cited

U.S. PATENT DOCUMENTS

| | | | |
|---|---|---|---|
| 3,331,364 | 7/1967 | Chariatte | 184/104.2 |
| 4,022,272 | 5/1977 | Miller | 184/104.3 |
| 4,423,708 | 1/1984 | Sweetland | 184/104.2 |
| 4,483,278 | 11/1984 | Kolacz | 123/41.33 |
| 4,607,601 | 8/1986 | Kohler | 123/195 C |
| 4,727,834 | 3/1988 | Isaka et al. | 123/196 W |
| 4,766,859 | 8/1988 | Miyaki et al. | 123/196 W |
| 4,790,273 | 12/1988 | Oguri et al. | 123/196 W |

*Primary Examiner*—E. Rollins Cross

*Attorney, Agent, or Firm*—Jeffers, Hoffman & Niewyk

[57] ABSTRACT

An oil cooler for small internal combustion engines is provided. The oil cooler comprises a heat exchanger mounted on the external surface of the engine crankcase, directly below the flywheel. The heat exchanger has an inner serpentine passageway in flow communication with the lubrication path of the engine oil. The heat exchanger further has a plurality of external fins, said fins being positioned directly below the flywheel. The flywheel includes a plurality of inlet apertures for drawing in cooling air to be blown over the heat exchanger.

23 Claims, 2 Drawing Sheets

INTEGRAL ENGINE BLOCK AIR COOLED ENGINE OIL COOLER

BACKGROUND OF THE INVENTION

The present invention relates generally to systems for cooling lubricating oil in internal combustion engines, and more particularly, to an air cooled engine oil cooler for use in a pressure lubricated, internal combustion engine.

In air cooled internal combustion engines, and in particular, in single cylinder die cast aluminum air cooled engines of the type having a pressure lubrication system and a vertically-oriented crankshaft, the temperature of the lubricating oil is higher than in liquid cooled engines. For example, when an air cooled engine having an enclosed or restricted cooling air flow is used in ambient air temperatures in excess of 100° F., the temperature of the engine lubricating oil may exceed 300° F. under normal operating conditions. At this temperature, the lubricating oil will rapidly oxidize and break down. This may result in excessive engine wear and premature engine failure due to the lack of lubrication. In order to prevent such excessive engine wear, it is generally preferred that the temperature of the lubricating oil not exceed 220° F. under normal operating conditions.

Prior art lubricating oil coolers that have been utilized with large and brute cylinder air cooled engines have generally used a finned tube type of heat exchanger within the cooling air ductwork and shroud of the engine air cooling system. This type of heat exchanger has been found effective in reducing the lubricating oil temperature of the air cooled engine, however, the cost and complexity of installation of this type of system make it impractical for use in small, relatively low-cost, single cylinder internal combustion engines of the type used in lawn mowers and the like.

Another technique for cooling engine lubricating oil is disclosed in U.S. Pat. No. 4,607,601. With this technique, oil flows under the influence of gravity in a generally downward direction through a series of cascade ribs arranged in a staggered pattern on the inside surface of a timing gear cassette housing. The staggered ribs are arranged to provide a circuitous cooling flow path for the oil as it returns to the sump. External ribs are provided on the outside of the housing for additional cooling. Although this system provides an effective technique for cooling lubricating oil, the system is limited in that it is entirely dependent upon conduction and radiation for heat transfer. No forced convection heat exchange is utilized. This system is applied to those engines wherein lubricating oil returns to the sump by gravity. It is not generally useful in engines utilizing a pressure lubrication system.

It is desired to provide an engine oil cooler for a pressure lubricated internal combustion engine that is low in cost, and that is effective in cooling the engine lubricating oil to a temperature below that which would cause the oil to rapidly oxidize and break down.

SUMMARY OF THE INVENTION

The present invention overcomes the disadvantages of prior art lubricating oil cooling systems by providing a cooling oil system wherein engine oil under pressure is circulated through a serpentine path in a finned heat exchanger mounted on the crankcase of the engine. The oil is then transported through the lubrication path of the engine. The lubricating oil is cooled by radiation and conduction from this serpentine path, as well as by direct convection from cooling air which is created by a rotating crankshaft driven flywheel that is positioned directly above the finned heat exchanger.

The invention solves the problems of prior art oil coolers by providing a cost-effective, space-saving oil cooler for an internal combustion engine that is effective in cooling the lubricating oil as it proceeds along the lubrication path in the internal combustion engine. Accordingly, an advantage of the present invention is that it provides an oil cooler for an internal combustion engine that is low in cost.

Another advantage of the present invention is that it provides an oil cooler for an internal combustion engine that requires only minor modifications to the outer surface of the engine crankcase, and occupies very little space inside the engine housing.

Yet another advantage of the present invention is that it provides an effective method for cooling the lubricating oil in the engine, which cooling occurs not only by conduction and radiation heat transfer, but also by direct convection heat transfer.

A further advantage of the present invention is that it provides an oil cooler that provides an optimum balance of heat transfer between the oil and the outside cooling air based upon the speed at which the engine is operated.

The invention, in one form thereof, provides an oil cooler in an internal combustion engine having a crankshaft, a crankcase, an oil sump in the crankcase and a pressure lubrication system for forcing lubricating oil from the oil sump through a lubrication path in the engine. The oil cooler comprises a heat exchanger having an inner surface mounted on the surface of the crankcase, and having an oil passageway extending therethrough in flow communication with the lubrication path. The heat exchanger further has an external surface which has a plurality of fins projecting outwardly therefrom. A blower means associated with the engine creates a flow of circulating air and directs the flow of circulating air over the plurality of fins.

The invention further provides, in one form thereof, an oil cooling system for an internal combustion engine of the type having a vertical crankshaft, a crankcase, an oil sump in the crankcase, a pressure lubrication system for forcing lubricating oil from the sump through a lubrication path in the engine, and a crankshaft-driven flywheel for circulating a stream of cooling air over the engine. The oil cooling system comprises pump means for forcing the lubricating oil through the lubrication path, and a heat exchanger having an inner surface mounted on the surface of the crankcase. The inner surface has an oil passageway extending therethrough in flow communication with the lubrication path so that lubricating oil passes through the passageway along the lubrication path. The heat exchanger further has an outer surface having a plurality of fins within the air stream of the circulating air, whereby the oil is cooled by direct convection heat exchange between the lubricating oil and a stream of cooling air.

DESCRIPTION OF THE PREFERRED EMBODIMENT

Figure 1:
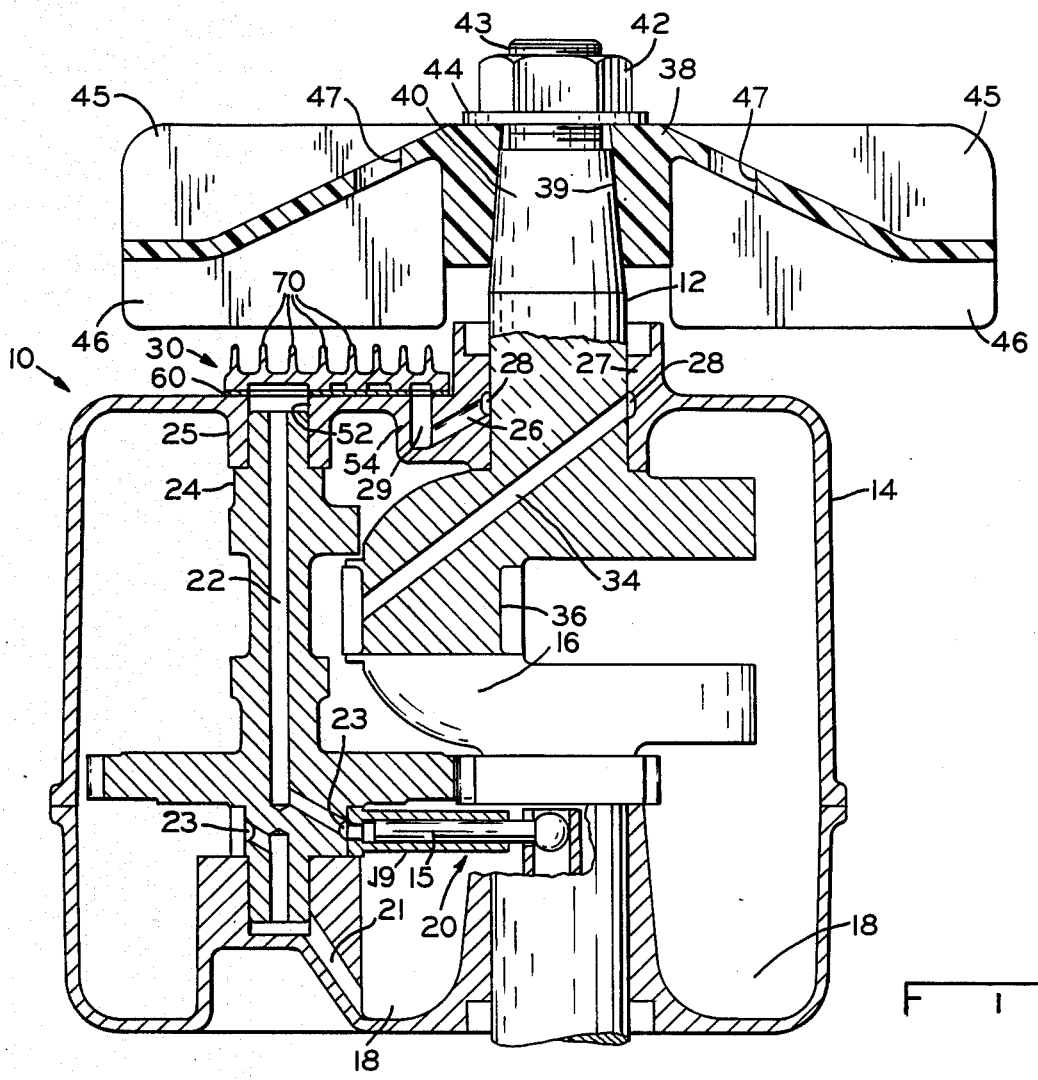
FIG. 1 is a side elevation view in cross-section of a small internal combustion engine embodying the present invention in accordance with one form thereof.
Figure 2:
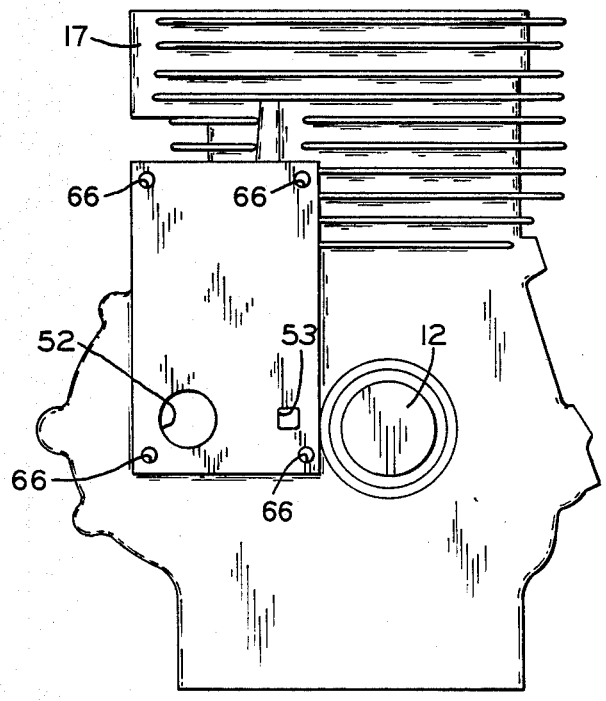
FIG. 2 is a plan view of the engine of FIG. 1, with the blower, gasket and heat exchanger removed.

Referring now to FIG. 1, there is illustrated a cross-sectional view of an internal combustion engine 10 of the type having a vertical crankshaft 12 that may be used to power a rotary lawn mower, for example. Engine 10 typically includes a crankcase 14 which houses and supports crankshaft 12. Crankshaft 12 has an eccentric portion 16, which via a connecting rod (not shown) is joined to a piston (not shown) which is mounted for reciprocable movement within a cylinder (not shown) housed in a finned cylinder block 17 (FIG. 2).

Engine 10 is lubricated by a pressure lubrication system of, for example, the type wherein oil is pumped from a sump 18 through a lubrication path in engine 10. Pump 20 is preferably a barrel-type lubrication pump, however, it will be appreciated that other types of pumps may be substituted for barrel-type pump 20. Pump 20 typically includes a plunger 15 housed in barrel 19. An eccentric on camshaft 24 works the plunger back and forth, forcing oil from sump 18 upwardly through lower camshaft passageway 21 into groove 23. As camshaft 24 rotates, oil from groove 23 is forced upwardly through camshaft hollow passageway 22 to cam bearing 25. After lubricating cam bearing 25, the oil proceeds along the lubrication path through a passageway in the upper portion of crankshaft 14 to top main bearing oil groove 28, wherein top main bearing 27 is lubricated. This passageway through the upper portion of the crankcase is conventional, and is not present in the crankcase utilized with the present invention as shown in FIG. 1. The present invention, in one form thereof, comprises a heat exchanger 30 mounted on the crankcase in the region between cam bearing 25 and top main crankshaft bearing 27, as shown in FIG. 1. Heat exchanger 30 includes a serpentine passageway 66 for the lubricating oil. Heat exchanger 30 and serpentine passageway 66 will be discussed later in greater detail. Referring again to the typical lubrication path, after main bearing 27 is lubricated, the oil is forced from main bearing groove 28 and passes into a drilled passage 34 in crankshaft 12. Oil is directed through drilled passage 34 to crankshaft connecting rod journal 36, wherein journal 36 is lubricated. The oil then spills from the connecting rod to lubricate the cylinder walls, and then drains to oil sump 18. The other internal parts of the engine may be lubricated by normal splash lubrication. With the exception of heat exchanger 30, the lubrication path described is conventional. Similar lubrication paths may be substituted for the path described above without departing from the scope of the invention.

Figure 5:
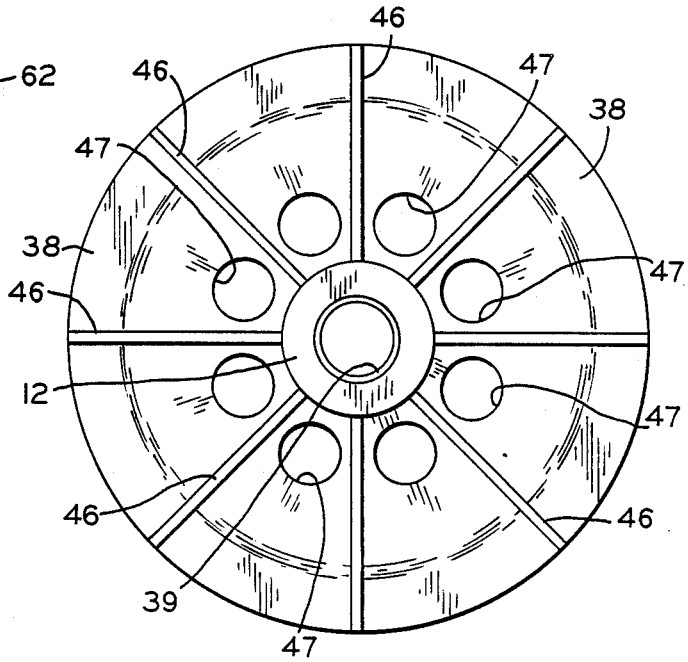
FIG. 5 is a view of the underside of the flywheel.

As shown in FIG. 1, a flywheel 38 having tapered central opening 39 is positioned on an upper portion 40 of crankshaft 12. Upper portion 40 has a corresponding taper with central opening 39 of flywheel 38. Nut 42 is threaded on upper end 43 of crankshaft 12, and together with washer 44 serves to retain flywheel 38 on crankshaft 12. Flywheel 38 has upper blades 45 and lower blades 46 for circulating cooling air throughout the engine housing. A plurality of inlet apertures 47 are arranged circumferentially around center opening 39 of flywheel 38, as shown in FIG. 5. Cooling air is drawn in through apertures 47 and blown over fins 70 of heat exchanger 30.

As stated previously, according to the present invention, a heat exchanger 30 is mounted on crankcase 14. As shown in FIG. 2, an upper portion 50 of crankcase 14 is milled flat on the external surface of crankcase 14 in the general vicinity of cam bearing 25 and main bearing 27, and extends rearwardly to finned cylinder block 17. A hole 52 is drilled through milled portion 50 of crankcase 14 into the end of cam bearing 25. A recess boss 54 is cast into crankcase 14, and hole 53 and oil passage 29 are drilled into recess boss 54 from milled surface 50 of crankcase 14. Oil passage 29 intersects oil passage 26 that leads to bearing groove 28 of top main bearing 27.

Figure 3:
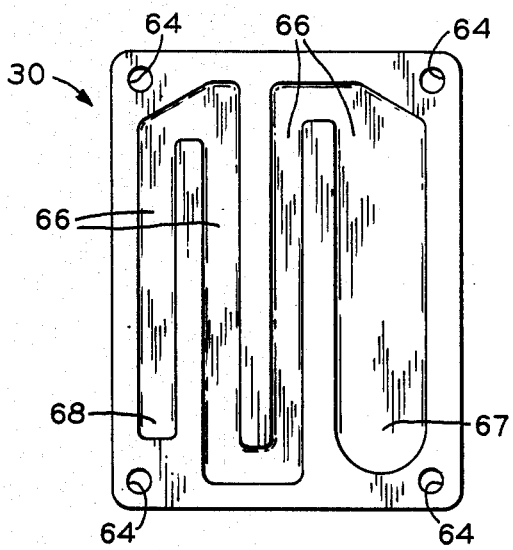
FIG. 3 is a view of the underside of the heat exchanger, showing the serpentine passageway.
Figure 6:
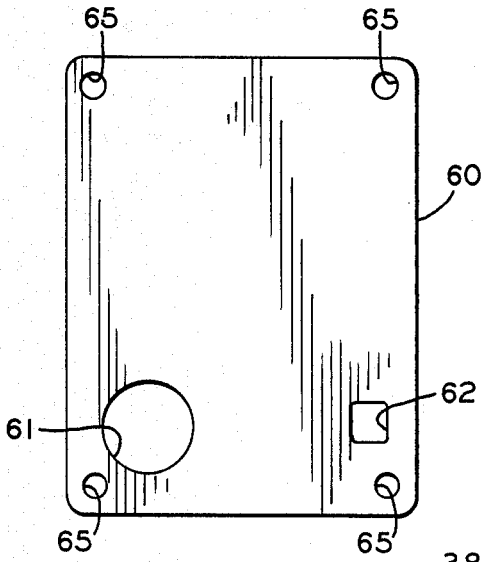
FIG. 6 is a plan view of the gasket.

A gasket 60 (FIG. 6) is positioned on milled surface 50, and covers substantially the entire flattened area of milled surface 50 of crankcase 14. Gasket 60 has an inlet hole or opening 61 which is aligned with hole 52 in the crankcase at cam bearing 25. Gasket 60 has outlet hole 62 which is aligned with hole 53 and oil passage 29 in recessed boss 54. Heat exchanger 30 is positioned above gasket 60 on milled surface 50, and is fastened to drilled holes in crankcase 14 by screws (not shown) inserted through holes 64 in heat exchanger 30, and through reciprocal holes 65 in gasket 60, and 66 in milled crankcase surface 50, respectively. Heat exchanger 30 is preferably stamped from ductile aluminum or copper. The underside of heat exchanger 30 is illustrated in FIG. 3. Embossed or coined oil passageway 66 in a serpentine pattern interconnects oil feed hole 52 with hole 53 leading to oil passage 29 in recessed boss 54. In passing through heat exchanger 30, the lubricating oil is forced upwardly through hole 52 of the crankcase, and continues through gasket inlet hole 61 and enters serpentine passageway 66 in the area generally designated as 67. Gasket 60 forms one wall of passageway 66 of heat exchanger 30. In addition, gasket 60 insulates the lubricating oil in the heat exchanger from the heat of crankcase 14. The oil passes through a serpentine passageway 66 until it reaches terminal portion 68, from which it passes through gasket outlet hole 62, and continues through hole 53 into oil passage 29. The oil is then forced along the lubrication path to oil groove 28, top main bearing 27, and so forth along the pressure lubrication system described previously.

Figure 4:
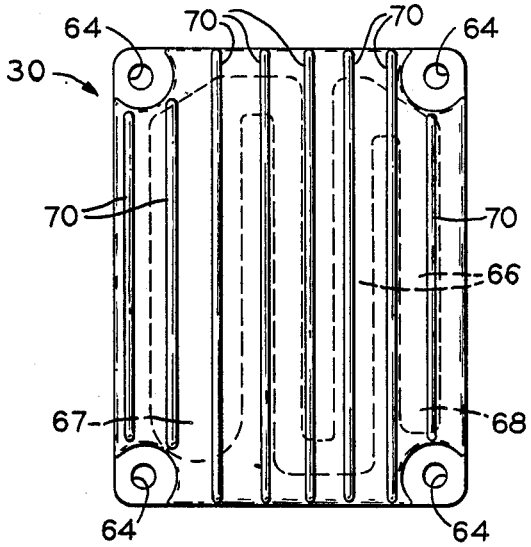
FIG. 4 is a plan view of the external surface of the heat exchanger, showing the serpentine passageway in dotted lines.

The upper side of heat exchanger 30 is illustrated in plan view in FIG. 4. The dotted lines in FIG. 4 represent the serpentine passageway on the underside of the heat exchanger. Upper side of heat exchanger 30 is equipped with a plurality of fins 70 projecting upwardly in a substantially perpendicular direction from gasket 60, as best shown in FIG. 1. Heat exchanger 30 is preferably positioned directly below crankshaft-driven flywheel 38. As stated, flywheel 38 includes air circulating blades 45, 46 for air cooling of engine 10, and also includes air inlet apertures 47. Heat exchange between the lubricating oil in serpentine passageway 66, and the cooling air occurs by direct convection, which causes a reduction in engine oil temperature. Since both the convection air flow created by the flywheel, and the oil flow that is pumped through the pressure lubrication system are proportional to the speed of crankshaft 12, an optimum balance of heat transfer between the oil and the cooling air may be achieved. At a high engine speed, pressure lubrication pump 20 operates to force oil from the sump 18 through the lubrication path at a more rapid rate than would occur at lower engine speed. Similarly, at high engine speed, the crankshaft-driven flywheel 30 rotates more rapidly and transfers more cooling air over fins 70 than at lower engine speed.

In an alternate embodiment, crankcase 14 is cast to have an integral cavity or recess in the area between cam bearing 25 and main crankshaft bearing 27. The cavity is covered with an extruded or die cast cover plate having fins cast in a serpentine passage for multiple passes of the oil within the cavity as it is directed from the cam shaft bearing to the crankshaft main bearing. External fins to mate with the fins in the cavity extend beyond the surface of the crankcase and extend into the air stream of flywheel blades 46. Direct convection heat transfer occurs through the immersed fins by conduction between the oil in the serpentine passageway and the air stream.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

I claim:

1. In an internal combustion engine comprising a crankshaft, a crankcase having an external surface, an oil sump in said crankcase, and a pressure lubrication means for forcing liquid lubricating oil from said oil sump through a lubrication path in the engine, an oil cooler comprising:

a heat exchanger having an inner surface mounted on the external surface of said crankcase, said heat exchanger having an oil passageway therein in flow communication with said lubrication path;

said heat exchanger further having an external surface having a plurality of fins projecting outwardly therefrom;

said lubrication means pumping the liquid oil through said heat exchanger passageway under positive pressure; and means associated with said engine for creating a flow of circulating air whereby the lubricating oil is cooled by direct convection heat exchange between said fins and said circulating air.

2. In an internal combustion engine of the type having a crankshaft, a crankcase having an external surface, an oil sump in said crankcase, and a pressure lubrication system for forcing lubricating oil from said oil sump through a lubrication path in the engine, an oil cooler comprising:

a heat exchanger having an inner surface mounted on the external surface of said crankcase, said heat exchanger having an oil passageway extending therethrough in flow communication with said lubrication path;

said heat exchanger further having an external surface having a plurality of fins projecting outwardly therefrom;

means associated with said engine for creating a flow of circulating air whereby the lubricating oil is cooled by direct convection heat exchange between said fins and said circulating air; and a gasket mounted between said heat exchanger inner surface and said crankcase external surface, said gasket forming a wall of said oil passageway, said gasket having an inlet opening for transmitting oil from said lubrication path to said heat exchanger oil passageway, and having an outlet opening for transmitting oil from said heat exchanger back to said lubrication path.

3. The engine of claim 2, wherein said oil passageway extends in a serpentine pattern through said heat exchanger from said inlet opening to said outlet opening.

4. The engine of claim 1, wherein said means for creating a flow of circulating air comprises a crankshaft-driven flywheel having air-circulating blades disposed on said flywheel.

5. The engine of claim 4, wherein said flywheel includes a plurality of inlet apertures on said flywheel for drawing in cooling air to be blown over said heat exchanger.

6. The engine of claim 1, wherein said heat exchanger is stamped from one of ductile aluminum and copper.

7. The engine of claim 2, wherein said heat exchanger and said gasket are fastened to said crankcase by a plurality of screws.

8. The oil cooler of claim 1, wherein said lubricating oil is forced through said lubrication path by pump means.

9. The oil cooler of claim 8, wherein said pump means comprises a barrel-type lubrication pump.

10. In an internal combustion engine having a vertical crankshaft, a crankcase having an external surface, an oil sump in said crankcase, a pressure lubrication system for forcing liquid lubricating oil from said oil sump through a lubrication path in the engine, and a crankshaft-driven flywheel for circulating a stream of cooling air over said engine, an oil cooling system comprising:

a heat exchanger having an inner surface mounted on the external surface of said crankcase, said inner surface having an oil passageway therein in flow communication with said lubrication path so that lubricating oil passes through said passageway along said lubrication path, said heat exchanger further having an outer surface having a plurality of fins within the air stream of said circulating air, whereby the oil is cooled by direct convection heat exchange between the lubricating oil and the stream of cooling air, said lubrication system including pump means for forcing said lubricating oil under positive pressure through said lubrication path and said heat exchanger.

11. The oil cooling system of claim 10, wherein said lubrication path through said engine comprises, in flow communication, an oil sump, a hollow passageway extending upwardly through the camshaft from said oil sump, an oil passageway in said heat exchanger, a main bearing having an oil groove, and a downwardly directed passage through said crankshaft for lubricating a connecting rod journal and returning said oil to the sump.

12. The oil cooling system of claim 10, wherein a gasket is mounted between said heat exchanger inner surface and said crankcase, said gasket having an inlet opening for transmitting oil from said lubrication path to said heat exchanger oil passageway, and having an outlet opening for transmitting oil from said heat exchanger to said lubrication path.

13. The oil cooling system of claim 12, wherein said oil passageway extends in a serpentine pattern through said heat exchanger from said inlet opening to said outlet opening.

14. The oil cooling system of claim 10, wherein said heat exchanger is mounted on the surface of said crankcase directly below said flywheel.

15. The oil cooling system of claim 14, wherein said flywheel includes a plurality of air-directing blades, for directing cooling air over said finned outer surface.

16. The oil cooling system of claim 10, wherein said heat exchanger is stamped from ductile aluminum or copper.

17. An oil cooler for cooling lubricating oil in an internal combustion engine of the type having a crankcase, an oil sump, a pressure lubrication system and an air-circulating crankshaft-driven flywheel comprising:

a heat exchanger mounted on an external surface of the crankcase of said engine, said heat exchanger having an oil passageway therein in flow communication with said pressure lubrication system, said heat exchanger further having a finned exterior surface;

said lubrication system including pump means for pumping liquid lubricating oil under positive pressure through said pressure lubrication system and heat exchanger; and means for passing said circulating air over said finned exterior surface whereby direct convection heat exchange occurs between said lubricating oil and said circulating air.

18. The oil cooler and engine of claim 17, wherein a gasket is mounted between said heat exchanger inner surface and said crankcase, said gasket having an inlet opening for transmitting oil from said lubrication path to said heat exchanger oil passageway, and having an outlet opening for transmitting oil from said heat exchanger to said lubrication path.

19. The oil cooler and engine of claim 18, wherein said oil passageway extends in a serpentine pattern through said heat exchanger from said inlet opening to said outlet opening.

20. The oil cooler and engine of claim 17, wherein said means for passing said circulating air over said finned exterior surface comprises air-directing blades disposed on an underside of said flywheel, said flywheel being positioned in said engine directly above said heat exchanger.

21. The oil cooler and engine of claim 17, wherein said pump means comprises a barrel-type lubrication pump.

22. The oil cooler and engine of claim 17, wherein said engine has a vertically-oriented crankshaft.

23. The oil cooler and engine of claim 18, wherein said gasket forms a wall of said oil passageway.

* * * * *